US010468815B2

(12) United States Patent
Hata et al.

(10) Patent No.: US 10,468,815 B2
(45) Date of Patent: Nov. 5, 2019

(54) BRANCH CONNECTOR

(71) Applicant: KYOCERA CORPORATION, Kyoto (JP)

(72) Inventors: Tetsuya Hata, Yokohama (JP); Shigeki Ohara, Isehara (JP); Toshiyuki Ishiguro, Yokohama (JP); Hiroshi Kobayashi, Aichi-ken (JP); Motoya Hara, Aichi-ken (JP)

(73) Assignees: Kyocera Corporation, Kyoto (JP); Toyota Jidosha Kabushiki Kaisha, Aichi (JP)

( * ) Notice: Subject to any disclaimer, the term of this patent is extended or adjusted under 35 U.S.C. 154(b) by 0 days.

(21) Appl. No.: 15/562,359

(22) PCT Filed: Jun. 28, 2016

(86) PCT No.: PCT/JP2016/003108
§ 371 (c)(1),
(2) Date: Sep. 27, 2017

(87) PCT Pub. No.: WO2017/046982
PCT Pub. Date: Mar. 23, 2017

(65) Prior Publication Data

US 2018/0277984 A1 Sep. 27, 2018

(30) Foreign Application Priority Data

Sep. 14, 2015 (JP) ..... 2015-181001

(51) Int. Cl.
*H01R 13/52* (2006.01)
*H01R 13/506* (2006.01)
(Continued)

(52) U.S. Cl.
CPC ..... *H01R 13/5216* (2013.01); *H01R 4/2433* (2013.01); *H01R 13/506* (2013.01); *H01R 13/521* (2013.01); *H01R 13/582* (2013.01)

(58) Field of Classification Search
CPC ..... H01R 13/5216; H01R 13/506; H01R 13/521; H01R 31/02; H01R 13/582; H01R 4/2433
See application file for complete search history.

(56) References Cited

U.S. PATENT DOCUMENTS 5,594,210 A * 1/1997 Yabe ..... H01R 4/70 174/76
6,095,859 A 8/2000 Maeda
(Continued)

FOREIGN PATENT DOCUMENTS

JP H08315902 A 11/1996
JP H11250974 A 9/1999
(Continued)

OTHER PUBLICATIONS

International Search Report dated Sep. 20, 2016, in corresponding International Application No. PCT/JP2016/003108 with Statement of Relevance of Non-English References.

*Primary Examiner* — Briggitte R. Hammond
(74) *Attorney, Agent, or Firm* — Duane Morris LLP

(57) ABSTRACT

Provided is a branch connector capable of achieving desired waterproofing functionality by supporting the waterproofing gel in a compressing manner, while stably maintaining a closed state by reducing repulsive force acting in an opening direction of a pair of split housings. The pair of split housings (a first split housing (10) and a second split housing (20)) includes a gel-escaping space (Z), formed around a gel-supporting space (Y), for accommodating portions of
(Continued)

waterproofing gels (a first waterproofing gel (70) and a second waterproofing gel (80)) pushed out of the gel-supporting space (Y).

7 Claims, 10 Drawing Sheets

(51) Int. Cl.
*H01R 4/2433* (2018.01)
*H01R 13/58* (2006.01)

(56) References Cited

U.S. PATENT DOCUMENTS 6,132,230 A 10/2000 Shinozaki et al.
6,196,863 B1 * 3/2001 Schwant ..... H01R 12/67 439/417
7,686,661 B2 * 3/2010 Shrum ..... H01R 4/5091 174/66

FOREIGN PATENT DOCUMENTS

JP 200040550 A 2/2000
JP 2605275 Y 4/2000
JP 3028988 B2 4/2000

* cited by examiner

BRANCH CONNECTOR

CROSS REFERENCE TO RELATED APPLICATION

This application claims priority to and the benefit of Japanese Patent Application No. 2015-181001 filed on Sep. 14, 2015, the entire contents of which are incorporated herein by reference.

TECHNICAL FIELD

The disclosure relates to a branch connector for connecting an additional cable (an electric wire) to an existing cable (an electric wire) coupled to an electronic device or an electrical apparatus.

BACKGROUND

A branch connector described above includes, as a basic structure, a pair of split housings capable of opening and closing in a manner clamping cables, and a relay contact to be electrically connected to a cable supported in a central supporting space of the pair of split housings in a closed state thereof.

The relay contacts are roughly classified into two known types. One of the types is provided with an insulation displacement groove configured to clamp an existing cable and a crimping terminal configured to crimp an additional cable (e.g., see patent literature PLT 1 set forth below). The other type is provided with a pair of insulation displacement grooves that are arranged in parallel with each other and configured to clamp the existing cable and the other cable, respectively (e.g., see patent literature PLT 2 set forth below).

The branch connector having the relay contact of either type is required to have a waterproofing structure for preventing the relay contact or the cables within the branch connector from contacting with water. As such, the applicant has been developing a technology for supporting a waterproofing gel within a gel-supporting space formed around the central supporting space (where the relay contact and the cables are supported) of the pair of split housings in the closed state.

CITATION LIST

Patent Literature

PLT 1: Japanese Patent No. 3028988
PLT 2: Japanese Utility Model Registration No. 2605275

SUMMARY

Technical Problem

As a result of diligent studies, we have found that, while the waterproofing gel needs to be supported in a compressed state within the gel-supporting space in order to achieve a desired waterproofing functionality, too much compressing force applied thereto may possibly generate repulsive force acting in an opening direction of the pair of split housings, leading to failure to stably maintain the closed state.

Therefore, it could be helpful to provide a branch connector capable of achieving desired waterproofing functionality by supporting the waterproofing gel in a compressing manner and also stably maintaining the closed state by reducing the repulsive force acting in the opening direction of the pair of split housings.

Solution to Problem

A branch connector of the disclosure includes: a pair of split housings capable of opening and closing together; a relay contact configured, in a closed state of the pair of split housings, to be supported in a central supporting space of the pair of split housings and electrically connected to a cable led to the central supporting space; a gel-supporting space formed around the central supporting space of the pair of split housings in the closed state of the pair of split housings; and a waterproofing gel supported in a compressed state within the gel-supporting space in the closed state of the pair of split housings. The pair of split housings includes a gel-escaping space, formed around the gel-supporting space and configured to accommodate a portion of the waterproofing gel pushed out of the gel-supporting space.

Preferably, one of the pair of split housings includes a waterproofing wall rising toward the other split housing, while the other split housing includes an accommodating wall configured to accommodate the waterproofing wall. Also, the gel-escaping space is formed between the waterproofing wall and the accommodating wall.

Preferably, at least one of the pair of split housings includes an anti-opening wall positioned outside of the relay contact supported in the central supporting space and configured to suppress opening outward of the relay contact.

Preferably, the waterproofing gel includes a stepped receiving portion for receiving the anti-opening wall in an accommodating manner.

Preferably, the waterproofing gel is made up of a pair of waterproofing gels that are supported by the pair of split housings, respectively, in an open state of the pair of split housings and brought into contact with each other within the gel-supporting space of the pair of split housings in the closed state of the pair of split housings.

Preferably, the pair of waterproofing gels have the same specifications.

Advantageous Effect

The disclosure provides a branch connector capable of achieving desired waterproofing functionality by supporting the waterproofing gel in a compressing manner and also stably maintaining the closed state by reducing repulsive force acting in an opening direction of the pair of split housings.

DETAILED DESCRIPTION

Figure 1:
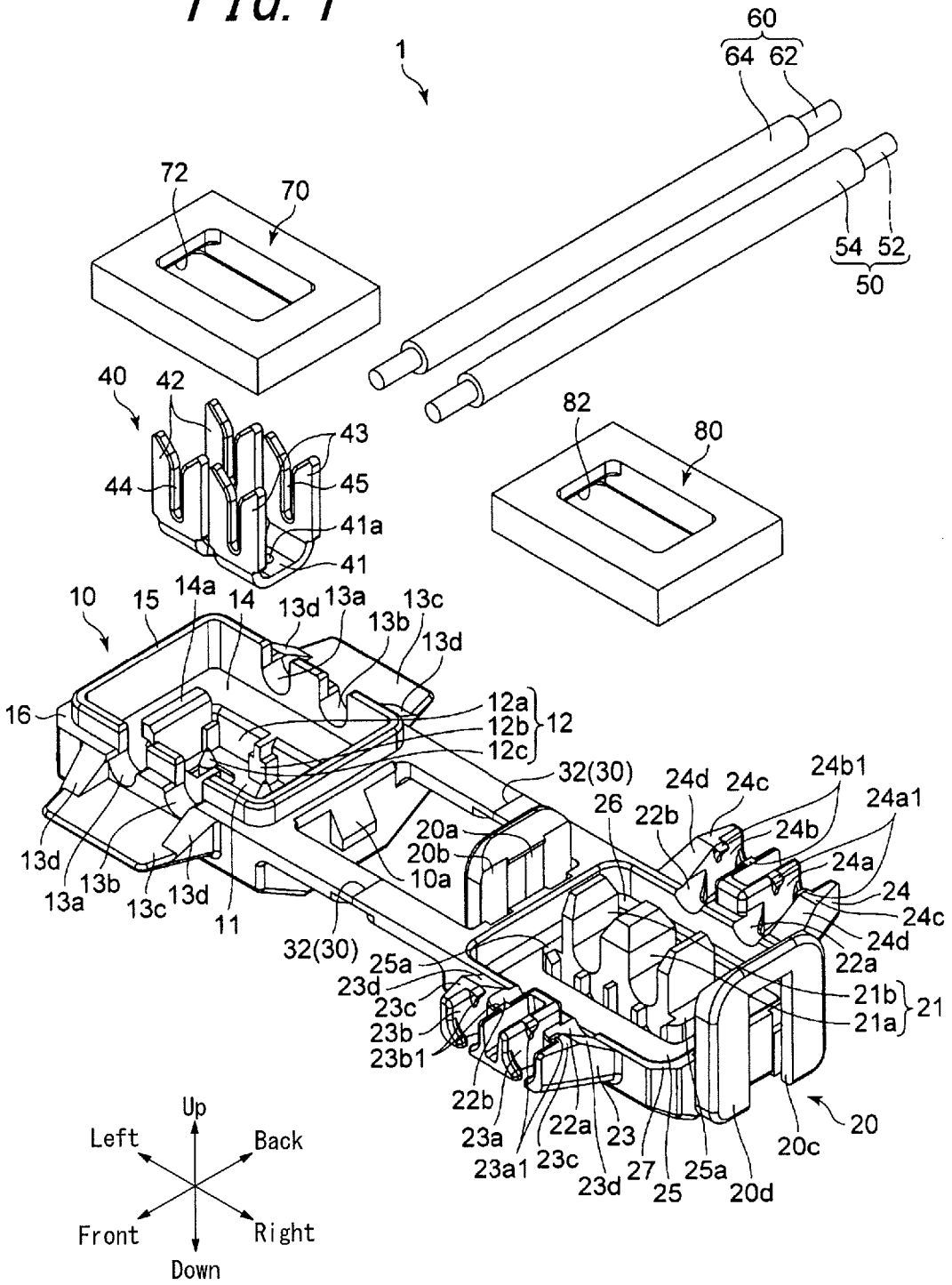
FIG. 1 is an exploded perspective view illustrating a branch connector according to the present embodiment in its open state.
Figure 2:
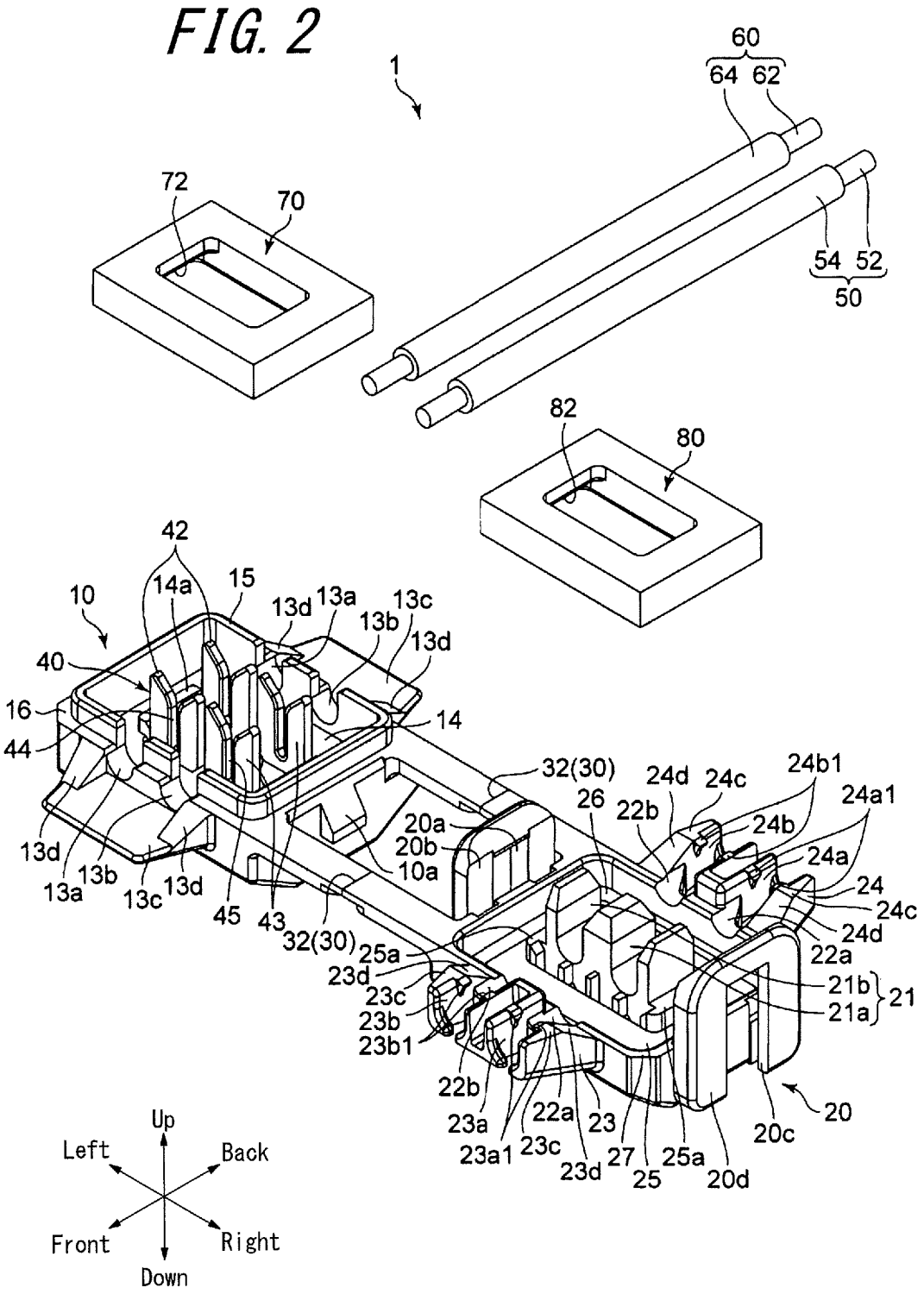
FIG. 2 is a perspective view illustrating a state in which a relay contact is mounted in a first split housing illustrated in FIG. 1.
Figure 3:
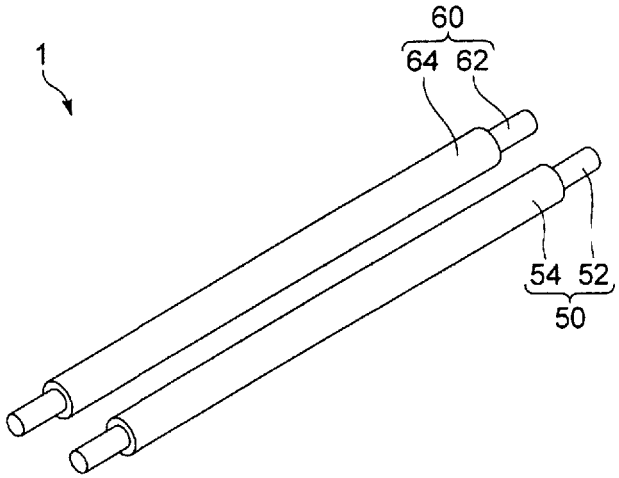
FIG. 3 is a perspective view illustrating a state in which a first waterproofing gel and a second waterproofing gel are mounted in the first split housing and a second split housing illustrated in FIG. 2, respectively.
Figure 3:
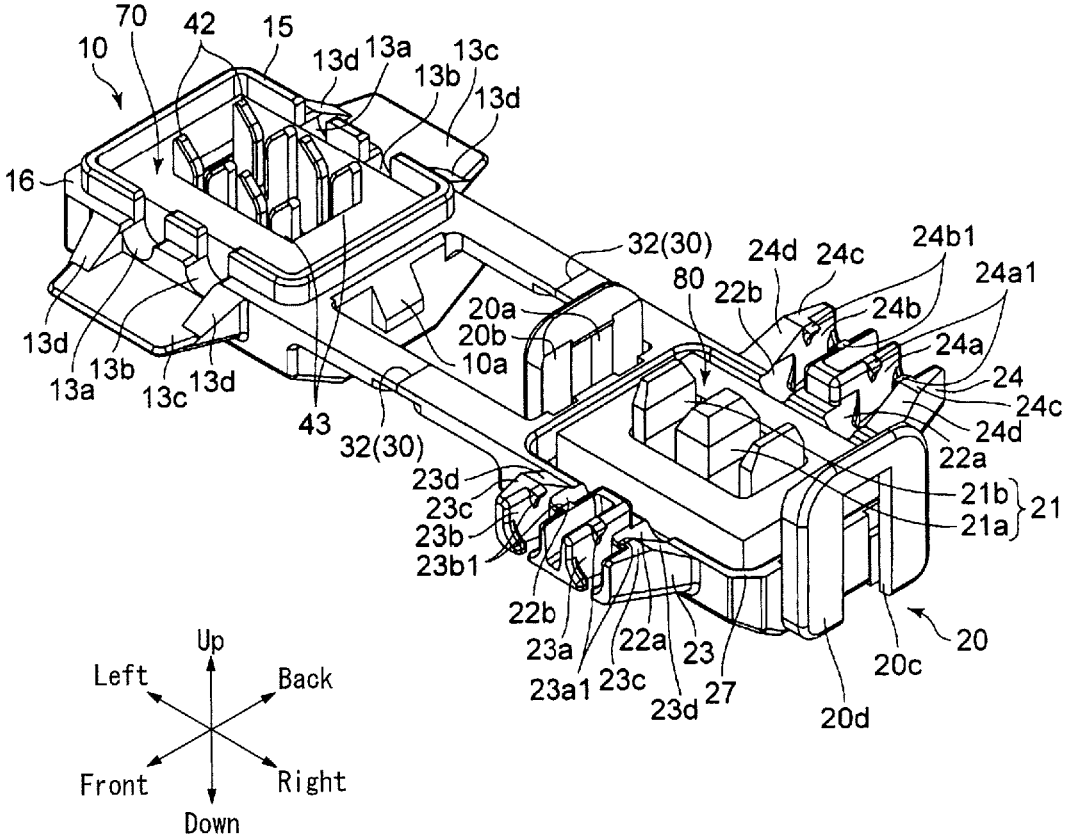
Figure 4:
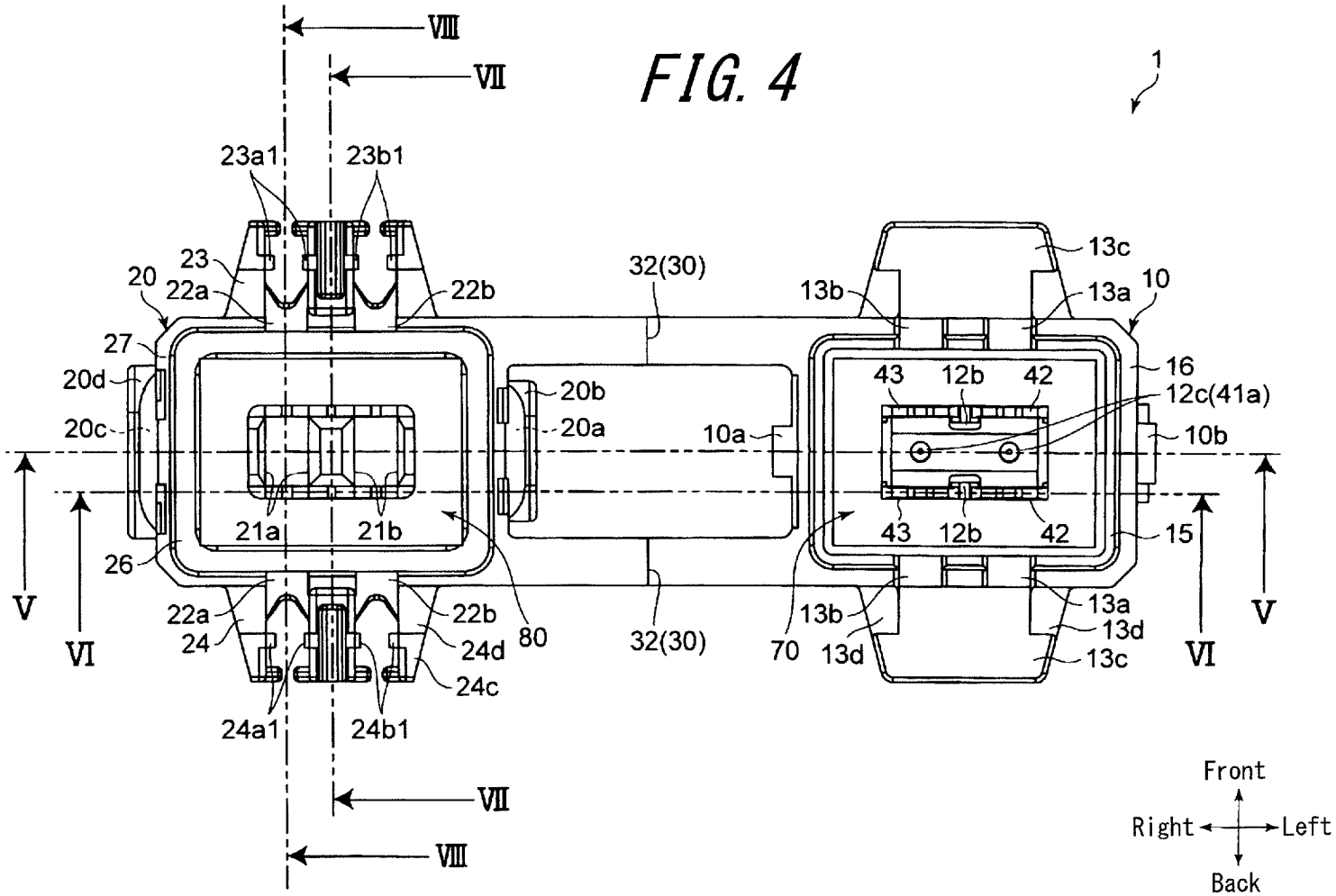
FIG. 4 is a plan view illustrating the branch connector according to the present embodiment in its open state (omitting first and second cables)
Figure 5:
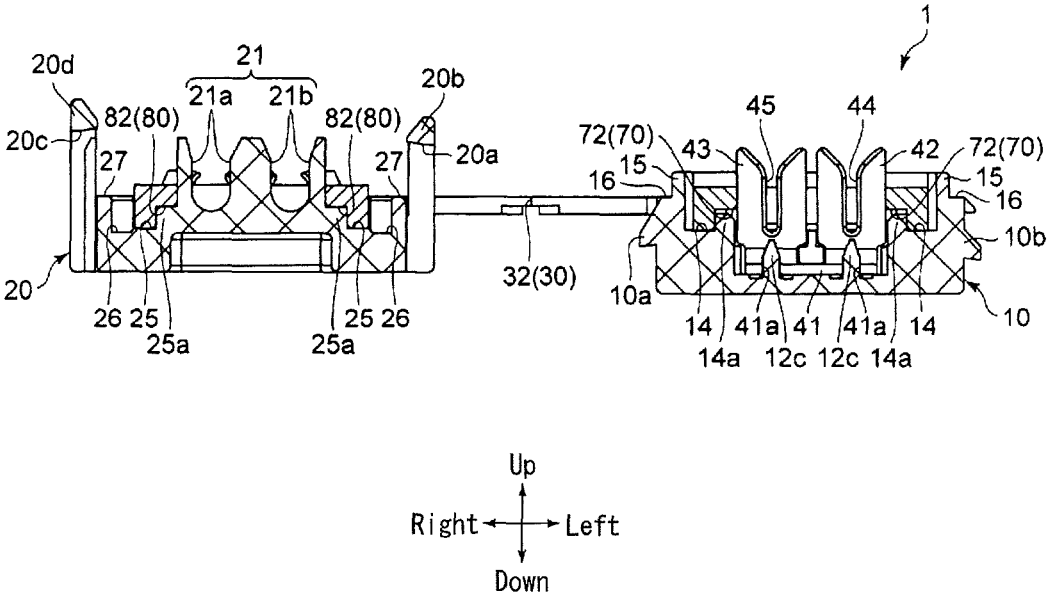
FIG. 5 is a cross-sectional view taken from line V-V of FIG. 4.
Figure 6:
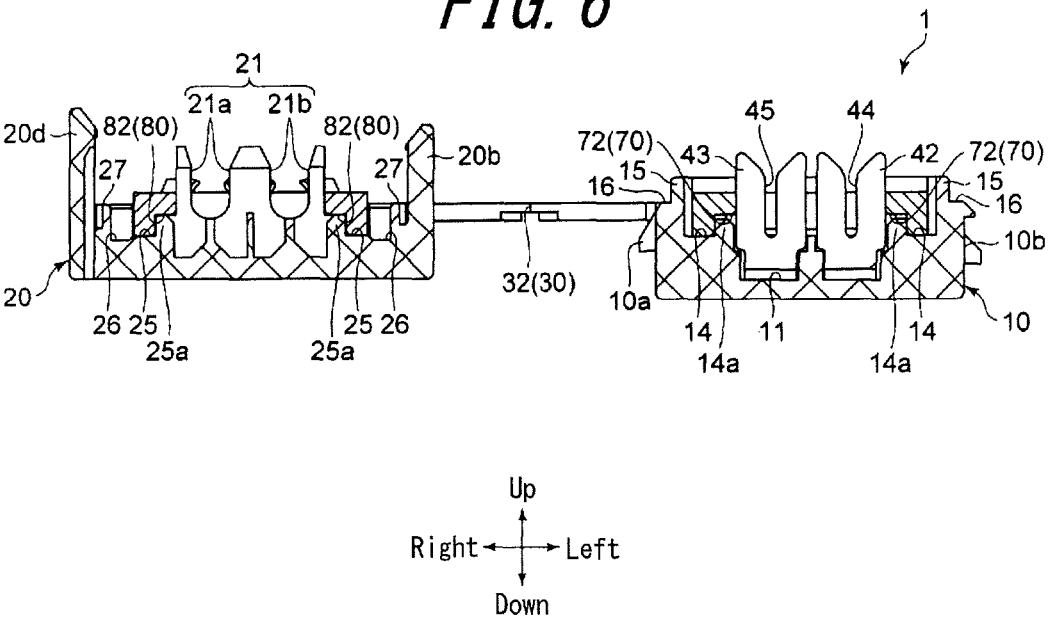
FIG. 6 is a cross-sectional view taken from line VI-VI of FIG. 4.
Figure 7:
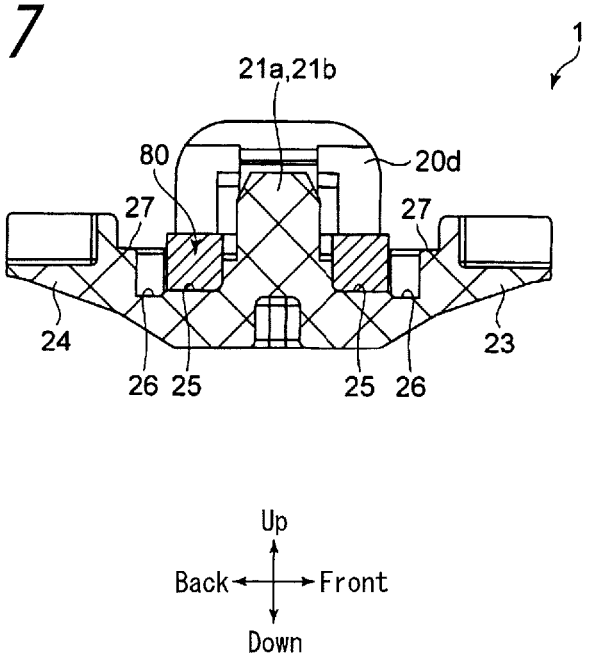
FIG. 7 is a cross-sectional view taken from line VII-VII of FIG. 4.
Figure 8:
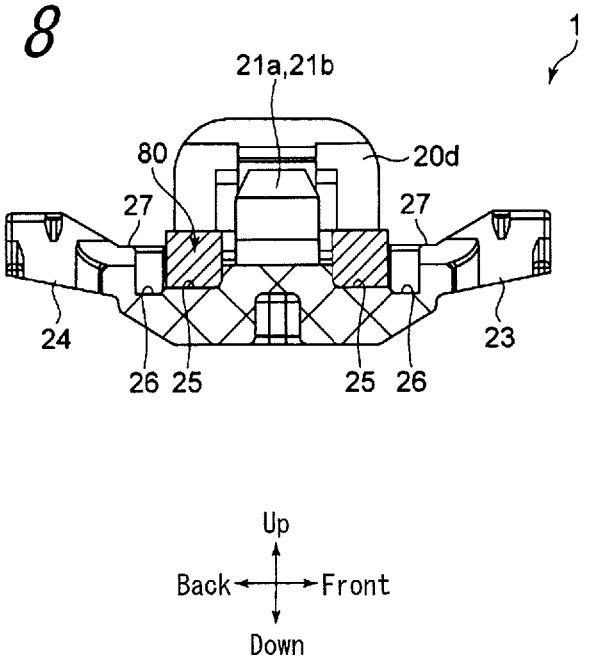
FIG. 8 is a cross-sectional view taken from line VIII-VIII of FIG. 4.
Figure 9:
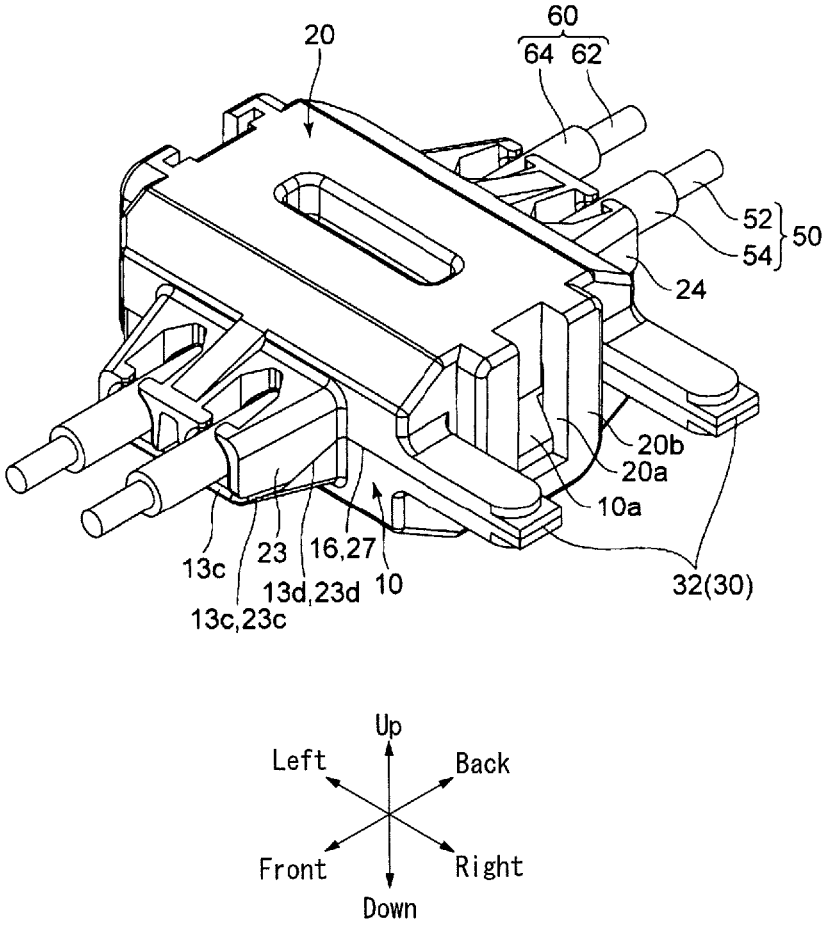
FIG. 9 is a perspective view illustrating the branch connector according to the present embodiment in its closed state.
Figure 10:
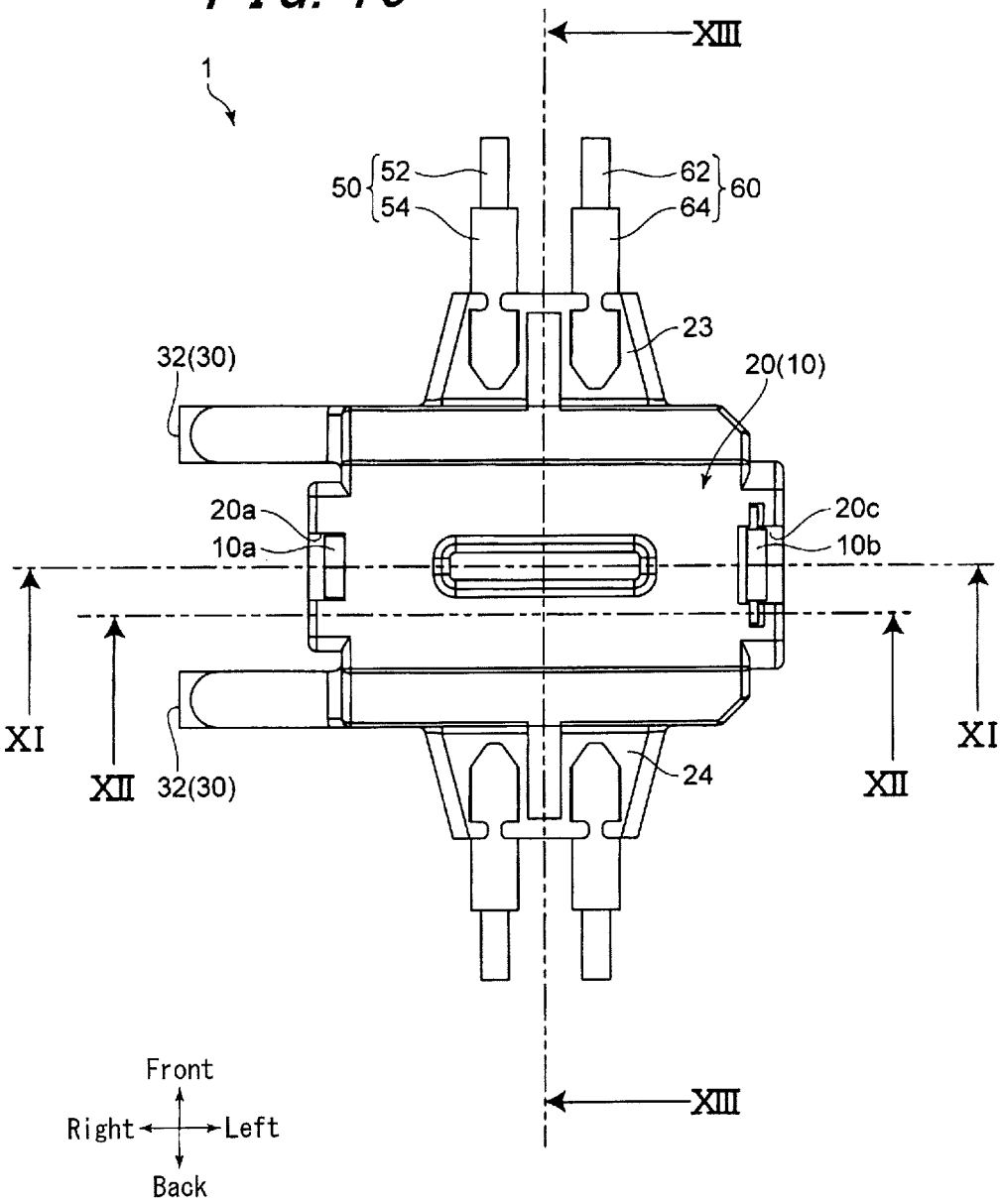
FIG. 10 is a plan view illustrating the branch connector according to the present embodiment in its closed state (with the first and second cables also illustrated)

Referring to FIGS. 1 to 13, a branch connector 1 according to the present embodiment will be described. Directions (front, back, up, down, left, and right) mentioned herein are based on directions of arrows illustrated in the drawings.

Configuration of Branch Connector 1

The branch connector 1 includes a first split housing 10, a second split housing 20, and a coupling portion 30 configured to couple the first split housing 10 and the second split housing 20 together. The first split housing 10, the second split housing 20, and the coupling portion 30 are integrally formed from a synthetic resin material having insulating properties. The coupling portion 30 includes a folding portion 32, which may be straightened or folded to open or close the first split housing 10 and the second split housing 20 (a pair of split housings) between an "open state" in which the housings are separated from each other and a "closed state" in which the housings are in contact with each other.

In the open state of the first split housing 10 and the second split housing 20, the first split housing 10 includes a locking member 10*a* formed on a right-side end thereof, and the second split housing 20 includes a locking portion 20*b* having a locking opening 20*a* formed on a left-side end of the second split housing 20. Also, the first split housing 10 includes a locking member 10*b* formed on a left-side end thereof, and the second split housing 20 includes a locking portion 20*d* having a locking opening 20*c* on a right-side end of the second split housing 20. When the locking member 10*a* engages with the locking opening 20*a* of the locking portion 20*b* and, simultaneously, the locking member 10*b* is engaged with the locking opening 20*c* of the locking portion 20*d*, the first split housing 10 and the second split housing 20 are locked to each other in the closed state.

As illustrated in FIG. 1, the first split housing 10 includes a central recess 11 formed at a center thereof. The central recess 11 includes a contact mounting groove 12. The contact mounting groove 12 includes a fixing portion 12*a*, a central convex portion 12*b* that is located at a center of a left-right direction of the fixing portion 12*a* and dividing the fixing portion 12*a* into a pair of left and right portions in a manner reducing a width of the fixing portion 12*a* in a front-back direction. The contact mounting groove 12 also includes a positioning protrusion 12*c* protruding from a bottom of the fixing portion 12*a* (a bottom of the central recess 11).

To the contact mounting groove 12 (the central recess 11) of the first split housing 10, a relay contact 40 is mounted. The relay contact 40 is obtained through molding and processing a resilient thin plate formed of copper alloy (e.g., phosphor bronze, beryllium copper, titanium copper) or Corson copper alloy using a progressive die (stamping). A surface of the relay contact 40 is subjected to undercoating with nickel plating, followed by tin copper plating or tin plating (or gold plating).

The relay contact 40 includes a base member 41 having a flat-plate shape extending in the left-right direction, a pair of first cable insulation displacement members (first cable insulation displacement blades) 42 having a flat-plate shape that are projecting from one of front-back side ends of the base member 41 and extending in a direction perpendicular to the base member 41, and a pair of second cable insulation displacement members (second cable insulation displacement blades) 43 having a flat-plate shape that are projecting from the other front-back side ends of the base member 41 and extending in the direction perpendicular to the base member 41. The base member 41, the first cable insulation displacement members 42, and the second cable insulation displacement members 43 are integrally formed. The base member 41 includes positioning holes 41*a* having a circular shape formed on a left side and a right side thereof. The first cable insulation displacement member 42 and the second cable insulation displacement member 43 include a first insulation displacement groove 44 and a second insulation displacement groove 45, respectively, that are slits linearly extending toward the base member 41. An upper opening of the first insulation displacement groove 44 is formed in a substantially V-shape that becomes wider as it locates upward. Similarly, an upper opening of the second insulation displacement groove 45 is formed in a substantially V-shape that becomes wider as it locates upward.

The relay contact 40 is mounted on the contact mounting groove 12 (the central recess 11) of the first split housing 10 in the following manner. That is, the central convex portion 12*b* is fitted into a gap between the first cable insulation displacement member 42 and the second cable insulation displacement member 43, and the base member 41 is attached to a bottom of the contact mounting groove 12. Further, a half portion of the first cable insulation displacement member 42 close to the base member 41 is fitted in the fixing portion 12*a* corresponding thereto and, simultaneously, a half portion of the second cable insulation displacement member 43 close to the base member 41 is fitted in the fixing portion 12*a* corresponding thereto. This causes a pair of projections 12*c* to engage with a pair of positioning holes 41*a* of the base member 41, attaching the relay contact 40 to the first split housing 10 in a positioning manner (see FIG. 5).

The relay contact 40 is configured to electrically connect a first cable 50 and a second cable 60 together. The first cable 50 is configured with a core wire (a twisted wire or a solid wire) 52 that is formed from a material (e.g., copper or aluminum) having conductivity and flexibility and has a surface covered with a coating 54, which has a tubular shape with flexibility and insulating properties. Similarly, the second cable 60 is configured with a core wire (a twisted wire or a solid wire) 62 that is formed from a material (e.g., copper or aluminum) having conductivity and flexibility and has a surface covered with a coating 64, which has a tubular shape with flexibility and insulating properties. The first cable 50 is a cable that is originally provided in a wiring object (e.g. an automobile) and coupled to a power source of the wiring object. On the other hand, the second cable 60 is a retrofitted cable coupled to the first cable 50 afterward. One end (a front end) of the second cable 60 is coupled to an electronic device or an electrical apparatus (e.g., a car navigation system).

The first split housing 10 includes a pair of first cable mounting grooves 13*a* spaced apart from each other in the front-back direction and a pair of second cable mounting grooves 13*b* spaced apart from each other in the front-back direction. A straight line connecting the pair of first cable mounting grooves 13*a* together and a straight line connecting the pair of second cable mounting grooves 13*b* together extend in parallel with each other in the front-back direction. The first cable mounting grooves 13*a* and the second cable mounting grooves 13*b* each have a semi-circular front shape.

At either end of the first split housing 10 in the front-back direction, a pair of lids 13*c* are formed extending in the front-back direction. Upper surfaces of the pair of lids 13*c* are substantially flush with lowest bottom surfaces of the first cable mounting grooves 13*a* and the second cable mounting grooves 13*b*. At either end of the pair of lids 13*c* in the left-right direction, triangular reinforcing portions 13*d* are formed inclining upward toward a center of the front-back direction of the first split housing 10.

At a center of the second split housing 20, a cable clamping projection 21 is formed and includes a first clamping groove 21*a* and a second clamping groove 21*b*. The first and second clamping grooves 21*a* and 21*b* have a U-shape in cross section and are arranged side by side in the left-right direction.

The second split housing 20 includes a pair of first cable mounting grooves 22*a* spaced apart from each other in the front-back direction and a pair of second cable mounting grooves 22*b* spaced apart from each other in the front-back direction. A straight line connecting the pair of first cable mounting grooves 22*a* together and a straight line connecting the pair of second cable mounting grooves 22*b* together extend in parallel with each other in the front-back direction. The first cable mounting grooves 22*a* and the second cable mounting grooves 22*b* each have a semi-circular front shape. In the closed state of the branch connector 1, the first cable mounting groove 13*a* of the first split housing 10 and a first cable mounting groove 22*a* of the second split housing 20 meet each other, forming a 'first cable mounting portion' in a circular shape. In the closed state of the branch connector 1, also, the second cable mounting groove 13*b* of the first split housing 10 and the second cable mounting groove 22*b* of the second split housing 20 meet each other, forming a 'second cable mounting portion' in a circular shape.

At either end portion of the second split housing 20 in the front-back direction, a pair of cable supporting arms 23 and 24 are formed extending in the front-back direction. The pair of cable supporting arms 23 and 24 include, in a corresponding manner, a pair of first cable supporting grooves 23*a* and 24*a* spaced apart from each other in the front-back direction and a pair of second cable supporting grooves 23*b* and 24*b* spaced apart from each other in the front-back direction. The pair of first cable supporting grooves 23*a* and 24*a* are positioned on a straight extension line that connects the pair of first cable mounting grooves 22*a* together. Similarly, the pair of second cable supporting grooves 23*b* and 24*b* are positioned on a straight extension line that connects the pair of second cable mounting grooves 22*b* together. The straight line connecting the pair of first cable supporting grooves 23*a* and 24*a* together and the straight line connecting the pair of second cable supporting grooves 23*b* and 24*b* together extend in parallel with each other in the front-back direction.

The cable supporting arm 23 includes a pair of anti-detachment projections 23*a*1 positioned on left and right end portions of the first cable holding groove 23*a*, and a pair of anti-detachment protrusions 23*b*1 positioned on left and right end portions of the second cable holding groove 23*b*. Similarly, the cable supporting arm 24 includes a pair of anti-detachment projections 24*a*1 positioned on left and right end portions of the first cable holding groove 24*a*, and a pair of anti-detachment protrusions 24*b*1 positioned on left and right end portions of the second cable holding groove 24*b*. The anti-detachment projections 23*a*1 and 24*a*1 are deformed in opposite directions in the left-right direction to increase a gap therebetween, thus allowing the insertion of the first cable 50 into the first cable supporting grooves 23*a* and 24*a*. The anti-detachment projections 23*a*1 and 24*a*1, after allowing the insertion of the first cable 50, elastically restore coming close to each other in the left-right direction to clamp the first cable 50. In this manner, the anti-detachment projections 23*a*1 and 24*a*1 prevent the first cable 50 from coming off the first cable supporting grooves 23*a* and 24*a*. Similarly, the anti-detachment projections 23*b*1 and 24*b*1 are elastically deformed in opposite directions in the left-right direction to increase a gap therebetweeen, thus allowing the insertion of the second cable 60 into the first cable supporting grooves 23*b* and 24*b*. The anti-detachment projections 23*b*1 and 24*b*1, after allowing the insertion of the second cable 60, elastically restore coming close to each other in the left-right direction to clamp the second cable 60. In this manner, the anti-detachment projections 23*b*1 and 24*b*1 prevent the second cable 60 from coming off the second cable supporting grooves 23*b* and 24*b*.

Here, in the closed state of the first split housing 10 and the second split housing 20, the lid 13*c* having a one-plate structure extending forward from the first split housing 10 and the first and second cable supporting grooves 23*a* and 23*b* of the cable supporting arm 23 cooperate with one another to support front portions of the first cable 50 and the second cable 60. Similarly, in the closed state of the first split housing 10 and the second split housing 20, the lid 13*c* having a one-plate structure extending backward from the first split housing 10 and the first and second cable supporting grooves 24*a* and 24*b* of the cable supporting arm 24 cooperate with one another to support back portions of the first cable 50 and the second cable 60.

More specifically, the cable supporting arm 23 includes a lid contacting surface 23*c* and an inclined contacting surface 23*d*. Similarly, the cable supporting arm portion 24 includes a lid contacting surface 24*c* and an inclined contacting surface 24*d* (see FIGS. 1 to 4). In the closed state of the first split housing 10 and the second split housing 20, the lid contacting surface 23*c* of the cable supporting arm 23 meets an upper surface of the lid 13*c* and, simultaneously, the inclined contacting surface 23*d* of the cable supporting arm 23 meets the triangular reinforcing portion 13*d*. In this state, the first cable 50 and the second cable 60 are supported at front portions thereof (see FIG. 9). Concurrently, in the closed state of the first split housing 10 and the second split housing 20, the lid contacting surface 24*c* of the cable supporting arm 24 meets an upper surface of the lid 13*c* and, simultaneously, the inclined contacting surface 24*d* of the cable supporting arm 24 meets the triangular reinforcing portion 13*d*. In this state, the first cable 50 and the second cable 60 are supported at back portions thereof.

In the branch connector 1 of the present embodiment, large portions of the cable supporting arms 23 and 24 are formed thin to facilitate easy elastic deformation of the anti-detachment projections 23*a*1, 24*a*1, 23*b*1, and 24*b*1. This tends to make the cable supporting arms 23 and 24 brittle. In the branch connector 1 of the present embodiment, however, the cable supporting arms 23 and 24 meet the lid 13*c* that has the one-plate structure and support the first cable 50 and the second cable 60. This structure reinforces strength of the first cable 50 and the second cable 60 against bending and so on.

Figure 11:
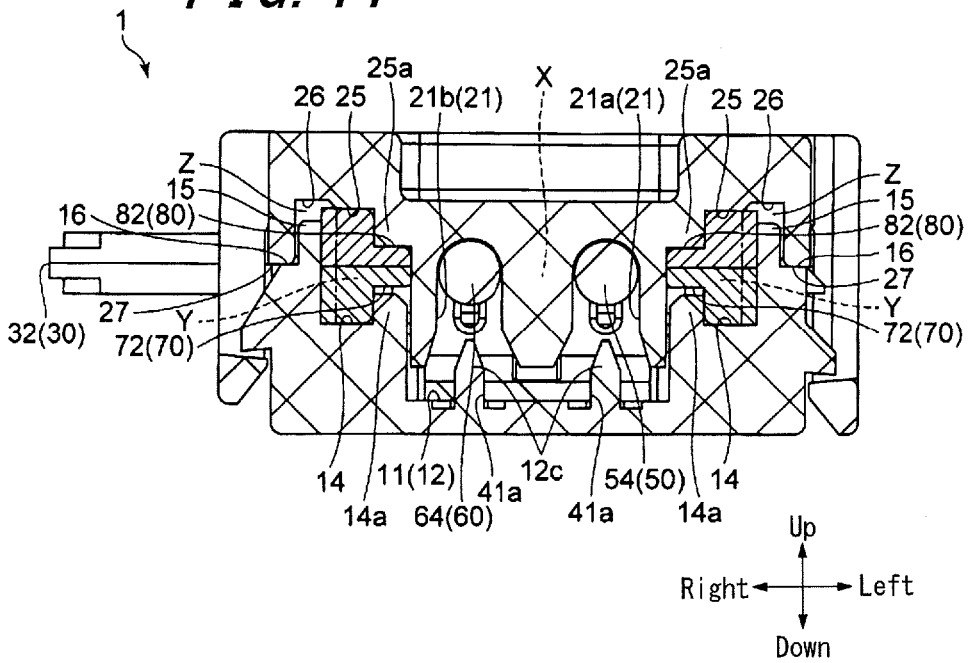
FIG. 11 is a cross-sectional view taken from line XI-XI of FIG. 10.
Figure 12:
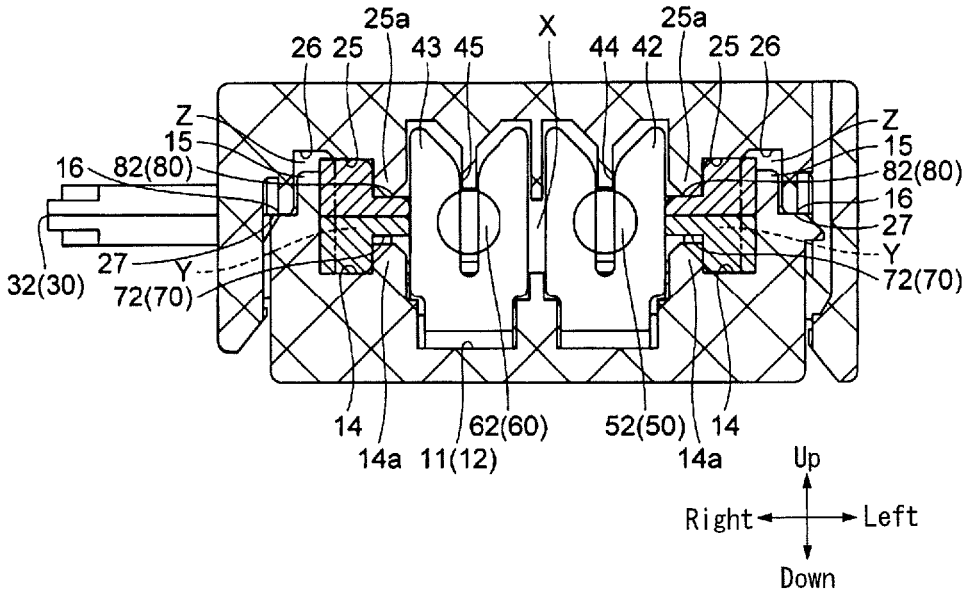
FIG. 12 is a cross-sectional view taken from line XII-XII of FIG. 10.
Figure 13:
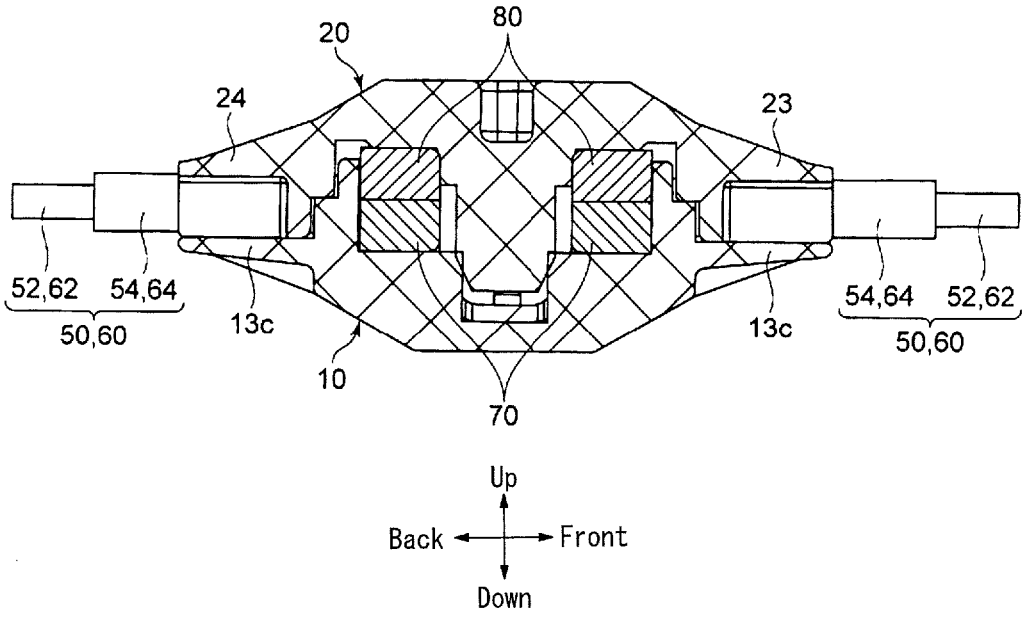
FIG. 13 is a cross-sectional view taken from line XIII-XIII of FIG. 10.

As illustrated in FIG. 11 and FIG. 12, in the closed state of the first split housing 10 and the second split housing 20, a central supporting space X is formed between the central recess 11 (the contact mounting groove 12), which is formed in a central portion of the first split housing 10, and the cable clamping projections 21 (the first and second clamping grooves 21*a* and 21*b*) of the second split housing 20. In the central supporting space X, the relay contact 40, the first cable 50, and second cable 60 are supported while being electrically connected to one another.

More specifically, in the open state of the first split housing 10 and the second split housing 20, the relay contact 40 is mounted and positioned on the central recess 11 (the contact mounting groove 12) of the first split housing 10.

Subsequently, the first cable 50 is positioned in the first clamping groove 21*a* of the cable clamping projection 21 and pushed into the first cable holding grooves 23*a* and 24*a* against the resistance of the anti-detachment protrusions 23*a*1 and 24*a*1 on the front and back sides. Similarly, the second cable 60 is positioned in the second clamping groove 21*b* of the cable clamping projection 21 and pushed into the second cable holding grooves 23*b* and 24*b* against the resistance of the anti-detachment protrusions 23*b*1 and 24*b*1 on the front and back sides. In this manner, the first cable 50 and second cable 60 are arranged side-by-side and held in the second split housing 20.

Then, the first split housing 10 and the second split housing 20 pivot about the folding portion 32 of the coupling portion 30 to approach each other. This makes the first cable 50 clamped between the first clamping groove 21*a* of the cable clamping projection 21 and a top portion (an inlet) of the first insulation displacement groove 44 of the first cable insulation displacement member 42 of the relay contact 40. Similarly, the second cable 60 is clamped between the second clamping groove 21*b* of the cable clamping projection 21 and a top portion (an inlet) of the second first insulation displacement groove 45 of the second cable insulation displacement member 43 of the relay contact 40. This state is referred to as a provisional holding state of the first cable 50 and second cable 60.

From the provisional holding state, lastly, the first split housing 10 and the second split housing 20 are turned to further approach each other. This causes the locking member 10*a* to engage with the locking opening 20*a* of the locking portion 20*b* and, also, the locking member 10*b* to engage with the locking opening 20*c* of the locking portion 20*d*. That is, the first split housing 10 and the second split housing 20 become locked to each other in the closed state. At this time, the coating 54 of the first cable 50 is cut by the first insulation displacement groove 44 such that the core wire 52 electrically connects with the relay contact 40. Concurrently, the coating 64 of the second cable 60 is cut by the second insulation displacement groove 45 such that the core wire 62 electrically connects with the relay contact 40.

The branch connector 1 according to the present embodiment has a waterproofing structure to prevent the relay contact 40, the first cable 50, and second cable 60, which are supported in the central supporting space X of the first split housing 10 and the second split housing 20, from coming into contact with water. The branch connector 1 also has a configuration as described below to suppress opening of the first cable insulation displacement member (the first cable insulation displacement blade) 42 and the second cable insulation displacement member (the second cable insulation displacement blade) 43 of the relay contact 40.

The first split housing 10 includes a first opposing surface 14 that surrounds the central recess 11 and is formed at a position higher than the central recess 11. The second split housing 20 includes a second opposing surface 25 that surrounds the cable clamping projections 21 (the first and second clamping grooves 21*a* and 21*b*). The first opposing surface 14 and the second opposing surface 25 have substantially the same rectangular frame shape in a plan view.

The first split housing 10 includes, inside left and right short sides of the first opposing surface 14, a pair of anti-opening walls 14*a* extending in the front-back direction. Similarly, the second split housing 20 includes, inside left and right short sides of the second opposing surface 25, a pair of anti-opening walls 25*a* extending in the front-back direction. As illustrated in FIG. 12, the pair of anti-opening walls 14*a* and the pair of anti-opening walls 25*a*, in the closed state of the first split housing 10 and the second split housing 20, are extending toward each other immediately outside the first cable insulation displacement member 42 and the second cable insulation displacement member 43 of the relay contact 40 supported in the central supporting space X.

As illustrated in FIG. 11 and FIG. 12, between the first opposing surface 14 (including the anti-opening walls 14*a*) of the first split housing 10 and the second opposing surface 25 (including the anti-opening walls 25*a*) of the second split housing 20 in the closed state of the first split housing 10 and the second split housing 20, a gel-supporting space Y is formed around the central supporting space X. In this gel-supporting space Y, a first waterproofing gel 70 and a second waterproofing gel 80 (a pair of waterproofing gels) are supported in a compressed state.

The first waterproofing gel 70, in a plan view, has a rectangular frame shape corresponding to the first opposing surface 14 of the first split housing 10. Also, the first waterproofing gel 70, inside left and right short sides thereof, includes a stepped receiving portion 72 for receiving the anti-opening wall 14*a* of the first split housing 10 in an accommodating manner.

The second waterproofing gel 80, in a plan view, has a rectangular frame shape corresponding to the second opposing surface 25 of the second split housing 20. Also, the second waterproofing gel 80, inside left and right short sides thereof, includes a stepped receiving portion 82 for receiving the anti-opening wall 25*a* of the second split housing 20 in the accommodating manner.

Here, the first and second waterproofing gels 70 and 80 may have the same specification (the same material, shape, and so on) for an improvement in mass productivity thereof.

As illustrated in FIGS. 3 to 7, in the open state of the first split housing 10 and the second split housing 20, the first waterproofing gel 70 is supported by the first opposing surface 14 of the first split housing 10 in a state where the stepped receiving portion 72 is receiving the anti-opening wall 14*a* in the accommodating manner. Similarly, the second waterproofing gel 80 is supported by the second opposing surface 25 of the second split housing 20 in a state where the stepped receiving portion 82 is receiving the anti-opening wall 25*a* in the accommodating manner. The first and second cables 50 and 60, after the second waterproofing gel 80 is supported in the second split housing 20, are mounted on top of the second waterproofing gel 80 in the second split housing 20 (see FIG. 3). Then, in the closed state of the first split housing 10 and the second split housing 20, the first waterproofing gel 70 and the second waterproofing gel 80 are supported being in contact with each other and compressed together (in a squashed state) in the gel-supporting space Y. That is, a total volume of the first waterproofing gel 70 and the second waterproofing gel 80 in their free states is set to be larger than a volume of the gel-supporting space Y.

As illustrated in FIG. 11 and FIG. 12, the first split housing 10 includes, at a periphery of the gel-supporting space Y, a waterproofing wall 15 rising toward the second split housing 20. The second split housing 20 includes an accommodating wall (an opposing wall) 26 for accommodating (opposing to) the waterproofing wall 15. The waterproofing wall 15 extends from the first opposing surface 14 of the first split housing 10 to a position slightly lower than the second opposing surface 25 of the second split housing 20. The waterproofing wall 15 is in height sufficient to cover the most portions, in the up-down direction, of the first waterproofing gel 70 and the second waterproofing gel 80 that are supported in the gel-supporting space Y. Between a top of the waterproofing wall 15 of the first split housing 10 and the accommodating wall 26 of the second split housing 20, a gel-escaping space Z is formed to accommodate portions of the first and second waterproofing gels 70 and 80 pushed out of the gel-supporting space Y. In other words, the gel-supporting space Y and the gel-escaping space Z, near an upper end portion of the gel-supporting space Y, communicate with each other through a communication space that is much smaller than the gel-supporting space Y and gel-escaping space Z.

In FIG. 11 and FIG. 12, here, portions of the first waterproofing gel 70 and the second waterproofing gel 80 inside, with respect to the left-and-light direction, two-dot chain lines (virtual boundaries) extending in the vertical direction are in their free state (note that, for convenience of illustration, vertical thicknesses of the gels are illustrated smaller than actual vertical thicknesses), while portions of the first waterproofing gel 70 and the second waterproofing gel 80 expanding on both sides in the left-and-right direction outside the two-dot chain line (the virtual boundary) are in the compressed state. As is apparent from these figures, the first waterproofing gel 70 and the second waterproofing gel 80, in the open state of the first split housing 10 and the second split housing 20, are supported by the first opposing surface 14 and the second opposing surface 24, which together form the gel-supporting space Y in the closed state, with some extra space (allowance). The first waterproofing gel 70 and the second waterproofing gel 80, in the closed state of the first split housing 10 and the second split housing 20, are compressed between the first opposing surface 14 and the second opposing surface 25, filling the gel-supporting space Y and partially entering the gel-escaping space Z.

In the open state of the first split housing 10 and the second split housing 20, the first split housing 10 includes an outer peripheral first opposing surface 16 positioned lower than the waterproofing wall 15. The second split housing 20 includes an outer peripheral second opposing surface 27 positioned higher than the accommodating wall 26. In the closed state (a locked state) of the first split housing 10 and the second split housing 20, the outer peripheral first opposing surface 16 and the outer peripheral second opposing surface 27 have a surface contact with each other, forming an outer edge portion of the first split housing 10 and the second split housing 20 locked to each other.

First Action and Effect of Branch Connector 1

Due to the surface contact between the outer peripheral first opposing surface 16 of the first split housing 10 and the outer peripheral second opposing surface 27 of the second split housing 20 that is not tight enough to be able to block water, another waterproofing measure is necessitated. The branch connector 1 according to the present embodiment has a waterproofing structure against water entering through a minute gap between the outer peripheral first opposing surface 16 of the first split housing 10 and the outer peripheral second opposing surface 27 of the second split housing 20. Referring to FIG. 11 and FIG. 12, this waterproofing structure will be described as follows.

If water enters through the minute gap between the outer peripheral first opposing surface 16 of the first split housing 10 and the outer peripheral second opposing surface 27 of the second split housing 20, the waterproofing wall 15 of the first split housing 10, rising in the up-down direction orthogonal to an entering direction (the left-right direction) of water, allows a long creeping distance between an outside and an inside of the branch connector 1 (i.e., the central supporting space X in which the relay contact 40 and the first and second cables 50 and 60 are supported) and thus prevents the water from entering the central supporting space X.

If the water enters beyond the waterproofing wall 15, the gel-escaping space Z formed between the top of the waterproofing wall 15 and the accommodating wall 26 of the second split housing 20 to accommodate the portions of the first and second waterproofing gels 70 and 80 pushed out of the gel-supporting space Y (an upper peripheral portion of the second waterproofing gel 80) (note that, for convenience of illustration, FIG. 11 and FIG. 12 illustrate a state in which the portions of the first and second waterproofing gels 70 and 80 are not pushed out into the gel-escaping space Z) enables the portions of the waterproofing gels 70 and 80 to prevent the water from entering beyond the gel-escaping space Z.

If the water enters beyond the portions of the waterproofing gels in the gel-escaping space Z, the first waterproofing gel 70 and the second waterproofing gel 80 supported in the compressed manner within the gel-supporting space Y prevent the water from entering beyond the gel-supporting space Y.

As described above, the branch connector 1 according to the present embodiment has a three-step waterproofing structure configured with the waterproofing wall 15 of the first split housing 10, portions of the waterproofing gels 70 and 80 in the gel-escaping space Z, and the first and second waterproofing gels 70 and 80 supported in the compressed state within the gel-supporting space Y. Further, in the gel-supporting space Y the stepped receiving portion 72 of the first waterproofing gel 70 and the stepped receiving portion 82 of the second waterproofing gel 80 enable the longer creeping distances between the first split housing 10 and the first waterproofing gel 70 and also between the second split housing 20 and the second waterproofing gel 80. This structure offers a more effective waterproofing effect. Having the structure as described above, the branch connector 1, if water enters through the minute gap between the outer peripheral first opposing surface 16 of the first split housing 10 and the outer peripheral second opposing surface 27 of the second split housing 20, is able to reliably prevent the water from contacting with the relay contact 40 and the first and second cables 50 and 60 supported in the central supporting space X formed between the first split housing 10 and the second split housing 20.

Second Action and Effect of Branch Connector 1

When in the closed state of the first split housing 10 and the second split housing 20 the first waterproofing gel 70 and the second waterproofing gel 80 are supported in the compressed state, the first waterproofing gel 70 and the second waterproofing gel 80, utilizing the gel-supporting space Y and the gel-escaping space Z, may stretch in the front-back direction and the left-right direction orthogonal to an opening direction (the up-down direction) of the first split housing 10 and the second split housing 20. This configuration enables the branch connector 1 to stably maintain the closed state by reducing repulsive force acting in the opening direction (the up-down direction) of the first split housing 10 and the second split housing 20.

Third Action and Effect of Branch Connector 1

In the branch connector 1 according to the present embodiment, as illustrated in FIG. 12, the first split housing 10 and the second split housing 20 include the anti-opening wall 14*a* and the anti-opening wall 25*a*, respectively, that are extending toward each other and positioned immediately outside the first cable insulation displacement member 42 and the second cable insulation displacement member 43 of the relay contact 40 supported in the central supporting space X. With this configuration, when, for example, due to large diameters of the first and second cables 50 and 60 connected to the relay contact 40, force acting in a direction opening the first and second cable insulation displacement members 42 and 43 outward (moving the first cable insulation displacement member 42 to its left side and the second cable insulation displacement member 43 to its right side) is applied to the first and second cable insulation displacement members 42 and 43, the anti-opening walls 14*a* and 25*a* receive this force and effectively prevent the first and second cable insulation displacement members 42 and 43 from opening outward.

The above embodiment exemplifies the branch connector 1 having the relay contact 40 of what is called an insulation displacement type having a pair of insulation displacement grooves 44 and 45 arranged in parallel to clamp the first cable 50, which is an existing cable, and the second cable 60, which is a retrofitted cable. However, the disclosure is applicable also to a branch connector having a relay contact of what is called a crimp type having an insulation displacement groove for clamping the existing cable and a crimping terminal for crimping the retrofitted cable.

The above embodiment exemplifies the branch connector 1 in which the waterproofing wall 15 formed in the first split housing 10 and the accommodating wall 26 formed in the second split housing 20 define the gel-escaping space Z therebetween. However, an inverted positional relationship is also possible. That is, the waterproofing wall may be formed in the second split housing 20, while the accommodating wall may be formed in the first split housing 10, in such a manner as to define the gel-escaping space Z therebetween.

The above embodiment exemplifies the branch connector 1 in which the anti-opening wall 14*a* and the anti-opening wall 25*a* are formed in the first split housing 10 and the second split housing 20, respectively. However, any one or both of the anti-opening wall 14*a* of the first split housing 10 and the anti-opening wall 25*a* of the second split housing 20 may be omitted. In this case, the waterproofing gel accommodated in the split housing that has no anti-opening wall may have a rectangular frame shape in a plan view with an even thickness, omitting the stepped receiving portion for receiving the anti-opening wall in the accommodating manner.

Further, the above embodiment exemplifies the branch connector 1 in which the waterproofing gel is made up of the first waterproofing gel 70 and the second waterproofing gel 80 (a pair of waterproofing gels). However, the waterproofing gel may be a single piece. Also, the first waterproofing gel 70 and the second waterproofing gel 80 do not necessarily need to have the same specifications. For example, the first waterproofing gel 70 and the second waterproofing gel 80 may be designed in accordance with shapes of the first opposing surface 14 of the first split housing 10 and the second opposing surface 25 of the second split housing 20, respectively.

REFERENCE SIGNS LIST

1 branch connector
10 first split housing (a pair of split housings)
10*a*, 10*b* locking member
11 central recess
12 contact mounting groove
12*a* fixing portion
12*b* central convex portion
12*c* positioning projection
13*a* first cable mounting groove
13*b* second cable mounting groove
13*c* lid
13*d* triangular reinforcing portion
14 first opposing surface
14*a* anti-opening wall
15 waterproofing wall
16 outer peripheral first opposing surface
20 second split housing (a pair of split housings)
20*a*, 20*c* locking opening
20*b*, 20*d* locking portion
21 cable clamping projection
21*a* first clamping groove
21*b* second clamping groove
22*a* first cable mounting groove
22*b* second cable mounting groove
23, 24 cable supporting arm
23*a*, 24*a* first cable holding groove
23*b*, 24*b* second cable holding groove
23*a*1, 24*a*1, 23*b*1, 24*b*1 anti-detachment protrusion
23*c*, 24*c* lid-contacting surface
23*d*, 24*d* inclined contacting surface
25 second opposing surface
25*a* anti-opening wall
26 accommodating wall (opposing wall)
27 outer peripheral second opposing surface
30 connecting portion
32 folding portion
40 relay contact
41 base member
41*a* positioning hole
42 first cable insulation displacement member (first cable insulation displacement blade)
43 second cable insulation displacement member (second cable insulation displacement blade)
44 first insulation displacement groove
45 second insulation displacement groove
50 first cable
52 core wire
54 coating
60 second cable

62 core wire
64 coating
70 first waterproofing gel (a pair of waterproofing gels)
72 stepped receiving portion
80 second waterproofing gel (a pair of waterproofing gels)
82 stepped receiving portion
X central supporting space
Y gel-supporting space
Z gel-escaping space

The invention claimed is:

1. A branch connector comprising:

a pair of split housings capable of opening and closing together;

a relay contact configured, in a closed state of the pair of split housings, to be supported in a central supporting space of the pair of split housings and electrically connected to a cable led to the central supporting space;

a gel-supporting space formed around the central supporting space of the pair of split housings in the closed state of the pair of split housings; and a waterproofing gel supported in a compressed state within the gel-supporting space in the closed state of the pair of split housings, wherein the pair of split housings includes a gel-escaping space, formed around the gel-supporting space and configured to accommodate a portion of the waterproofing gel pushed out of the gel-supporting space, wherein one of the pair of split housings includes a waterproofing wall rising toward the other split housing, while the other split housing includes an accommodating wall configured to accommodate the waterproofing wall, wherein the gel-escaping space is formed between the waterproofing wall and the accommodating wall, and wherein the gel-escaping space is a space formed by the one and the other split housing only in the closed state of the pair of split housings and the gel-escaping space is formed around the gel-supporting space in a direction perpendicular to a direction in which the waterproofing wall extends into the other split housing.

2. The branch connector according to claim 1, wherein at least one of the pair of split housings includes an anti-opening wall positioned outside of the relay contact supported in the central supporting space and configured to suppress opening outward of the relay contact.

3. The branch connector according to claim 2, wherein the waterproofing gel includes a stepped receiving portion for receiving the anti-opening wall in an accommodating manner.

4. The branch connector according to claim 1, wherein the waterproofing gel is made up of a pair of waterproofing gels that are supported by the pair of split housings, respectively, in an open state of the pair of split housings and brought into contact with each other within the gel-supporting space of the pair of split housings in the closed state of the pair of split housings.

5. The branch connector according to claim 4, wherein the pair of waterproofing gels have the same specifications.

6. The branch connector according to claim 4, wherein the waterproofing wall extends into the other split housing beyond contacting surfaces between the pair of waterproofing gels within the gel-supporting space of the pair of split housings in a closed state of the pair of split housings.

7. The branch connector according to claim 1, wherein the gel-escaping space is formed by the gel-supporting space and an outer peripheral wall of the other split housing in a closed state of the pair of split housings.

* * * * *